US007836677B2

(12) United States Patent
Bland

(10) Patent No.: US 7,836,677 B2
(45) Date of Patent: Nov. 23, 2010

(54) AT LEAST ONE COMBUSTION APPARATUS AND DUCT STRUCTURE FOR A GAS TURBINE ENGINE

(75) Inventor: Robert J. Bland, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 433 days.

(21) Appl. No.: 11/498,479

(22) Filed: Aug. 3, 2006

(65) Prior Publication Data

US 2010/0229561 A1 Sep. 16, 2010

Related U.S. Application Data

(60) Provisional application No. 60/790,477, filed on Apr. 7, 2006.

(51) Int. Cl.
*F02C 3/00* (2006.01)

(52) U.S. Cl. ..... 60/39.37; 60/732; 60/733

(58) Field of Classification Search ..... 60/39.37, 60/733, 39.17, 722, 732, 269, 737, 752
See application file for complete search history.

(56) References Cited

U.S. PATENT DOCUMENTS

| | | | | |
|---|---|---|---|---|
| 2,851,853 | A * | 9/1958 | Quick | 60/262 |
| 3,971,209 | A | 7/1976 | de Chair | |
| 4,356,698 | A * | 11/1982 | Chamberlain | 60/733 |
| 5,943,866 | A | 8/1999 | Lovett et al. | |
| 6,047,550 | A | 4/2000 | Beebe | |
| 6,082,111 | A | 7/2000 | Stokes | |
| 6,164,055 | A | 12/2000 | Lovett et al. | |
| 6,311,471 | B1 | 11/2001 | Waldherr et al. | |
| 6,311,473 | B1 | 11/2001 | Benjamin et al. | |
| 6,460,343 | B1 | 10/2002 | Rakhmailov | |
| 6,619,026 | B2 | 9/2003 | Carelli et al. | |
| 6,672,070 | B2 | 1/2004 | Bland et al. | |
| 6,786,047 | B2 | 9/2004 | Bland et al. | |
| 6,793,831 | B1 * | 9/2004 | Paul et al. | 216/36 |
| 7,021,562 | B2 | 4/2006 | Mansour et al. | |
| 7,028,483 | B2 | 4/2006 | Mansour et al. | |
| 2003/0106321 | A1 | 6/2003 | Von Der Bank | |
| 2004/0045295 | A1 | 3/2004 | Wiebe et al. | |
| 2005/0016178 | A1 | 1/2005 | Wasif et al. | |
| 2005/0028526 | A1 | 2/2005 | Von Der Bank | |
| 2005/0084812 | A1 | 4/2005 | Rakhmailov et al. | |
| 2006/0034689 | A1 | 2/2006 | Taylor et al. | |
| 2007/0017225 | A1 | 1/2007 | Bancalari et al. | |

OTHER PUBLICATIONS

U.S. Appl. No. 12/420,149, filed Apr. 8, 2009; Jody w. Wilson, first Inventor.

U.S. Appl. No. 11/498,480, filed Aug. 3, 2006, Bland, entitled An Axially Staged Combustion System for a Gas Turbine Engine.

Norman Chigier, The Future of Atomization and Sprays, Department of Mechanical Engineering, Carnegie Mellon University, Pittsburgh, Pennsylvania, USA.

* cited by examiner

*Primary Examiner*—William H Rodríguez
*Assistant Examiner*—Vikansha S Dwivedi

(57) ABSTRACT

A combustion apparatus and duct structure for a gas turbine engine are provided. The combustion apparatus comprises a combustion system to receive fuel and air, ignite at least a portion of the fuel and air and output a stream of first combustion products and any remaining fuel and air. The combustion apparatus further comprises structure positioned adjacent to the combustion system for receiving and accelerating the first combustion products and any remaining fuel and air from the combustion system. The duct structure receives the first combustion products and any remaining fuel and air from the combustion apparatus, allows any remaining fuel and air to combust to generate second combustion products, accelerates the first and second combustion products and outputs the first and second combustion products to a first row blade assembly.

19 Claims, 7 Drawing Sheets

AT LEAST ONE COMBUSTION APPARATUS AND DUCT STRUCTURE FOR A GAS TURBINE ENGINE

This application claims the benefit of U.S. Provisional Patent Application Ser. No. 60/790,477, filed Apr. 7, 2006, and entitled "Swirl Generating Combustion System," the disclosure of which is incorporated herein by reference.

This application is related to U.S. patent application Ser. No. 11/498,480, entitled "AN AXIALLY STAGED COMBUSTION SYSTEM FOR A GAS TURBINE ENGINE," now U.S. Pat. No. 7,631,499, which is filed concurrently herewith and hereby incorporated by reference herein.

FIELD OF THE INVENTION

The present invention is directed to at least one combustion apparatus and duct structure for a gas turbine engine.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gas travels to the turbine. Within the turbine are a series of rows of stationary vanes and rotating blades. Each pair of rows of vanes and blades is called a stage. Typically, there are four stages in a turbine. The rotating blades are coupled to a shaft. As the working gas expands through the turbine, the working gas causes the blades, and therefore the shaft, to rotate.

A coolant, such as air, may flow out from orifices in the first row of vanes to cool the vanes. That coolant reduces the temperature of the working gas by dilution as the working gas passes through the first row of vanes in the turbine assembly. This decrease in temperature in the working gas prior to impinging upon the first row of blades decreases the efficiency of the gas turbine engine. Further, the elements comprising the first row of vanes are costly.

SUMMARY OF THE INVENTION

In accordance with a first aspect of the present invention, at least one combustion apparatus and duct structure for a gas turbine engine are provided. The at least one combustion apparatus comprises a combustion system to receive fuel and air, ignite at least a portion of the fuel and air and output a stream of first combustion products and any remaining fuel and air. The at least one combustion apparatus further comprises structure positioned adjacent to the combustion system for receiving and accelerating the first combustion products and any remaining fuel and air from the combustion system. The duct structure receives the first combustion products and any remaining fuel and air from the at least one combustion apparatus, allows any remaining fuel and air to combust to generate second combustion products, accelerates the first and second combustion products and outputs the first and second combustion products to a first row blade assembly to effect rotation of the first row blade assembly. Substantially all of the momentum in a direction normal to a machine axis of the first and second combustion products is imparted prior to the duct structure and substantially all of the momentum in a direction substantially parallel to the machine axis of the first and second combustion products is imparted within the duct structure. Preferably, the combustion system is an axially staged combustion system.

The duct structure may comprise a duct having an annular inner cavity with at least one entrance and an annular exit. The exit may output the first and second combustion products at a velocity having axial and tangential components required to effect a desired rotation of the first row blade assembly.

The at least one combustion apparatus may further comprise a transition element coupled between the accelerating structure and the at least one entrance of the duct to direct the first combustion products and any remaining fuel and air to the at least one duct entrance and into the annular inner cavity of the duct. Any remaining fuel and air in the annular inner cavity will combust in the annular inner cavity to generate the second combustion products.

The annular inner cavity in the duct may further comprise a J-shaped cross section.

The transition element may be canted inwardly at an angle of from about 10 degrees to about 40 degrees to a tangent to the annular inner cavity of the duct.

The at least one combustion apparatus preferably comprises a plurality of combustion apparatuses and the at least one entrance in the duct preferably comprises a plurality of entrances in the duct. For example, a first transition element of a first combustion apparatus may be coupled between an accelerating structure of the first combustion apparatus and a first entrance in the duct and a second transition element of a second combustion apparatus may be coupled between an accelerating structure of the second combustion apparatus and a second entrance in the duct.

The structure positioned adjacent to the combustion system for receiving and accelerating the first combustion products and any remaining fuel and air from the combustion system may comprise a cone.

The duct, each transition element and each cone may be made from one of an oxide system ceramic matrix composite, a nickel-based superalloy and a cobalt-based superalloy. If made from a superalloy, the duct, transition elements and cones are preferably cooled via air or steam.

In accordance with a second aspect of the present invention, at least one combustion apparatus, duct structure and a rotatable first row blade assembly for a gas turbine engine are provided. The at least one combustion apparatus comprises a combustion system to receive fuel and air, ignite at least a portion of the fuel and air and output a substantially linear stream of combustion products and any remaining fuel and air. The at least one combustion apparatus further comprises structure positioned adjacent to the combustion system for receiving and accelerating the combustion products and any remaining fuel and air from the combustion system. The duct structure receives the accelerated combustion products and any remaining fuel and air from the at least one combustion apparatus, allows any remaining fuel and air to combust and outputs combustion products directly to the first row blade assembly to effect rotation of the first row blade assembly. A vane assembly is not provided between the duct structure and the first row blade assembly.

In accordance with a third aspect of the present invention, a process is provided for generating and outputting combustion products to a first row blade assembly within a gas turbine engine. The process comprises providing fuel and air to a first injector; igniting at least a portion of the fuel and air to generate a first flame front; providing fuel to a second injector such that the fuel exits the second injector downstream of the first flame front; directing combustion products, any remaining fuel and air provided to the first injector and any remaining fuel provided to the second injector to an annular inner cavity of a duct; and outputting combustion products through an annular exit in the duct directly to a first row blade assembly to effect rotation of the first row blade assembly.

The process may further comprise accelerating combustion products, any remaining fuel and air provided to the first injector and any remaining fuel provided to the second injector prior to directing the combustion products, any remaining fuel and air provided to the first injector and any remaining fuel provided to the second injector to the duct annular inner cavity.

The process may still further comprise providing air to the second injector.

DETAILED DESCRIPTION OF THE INVENTION

Figure 1:
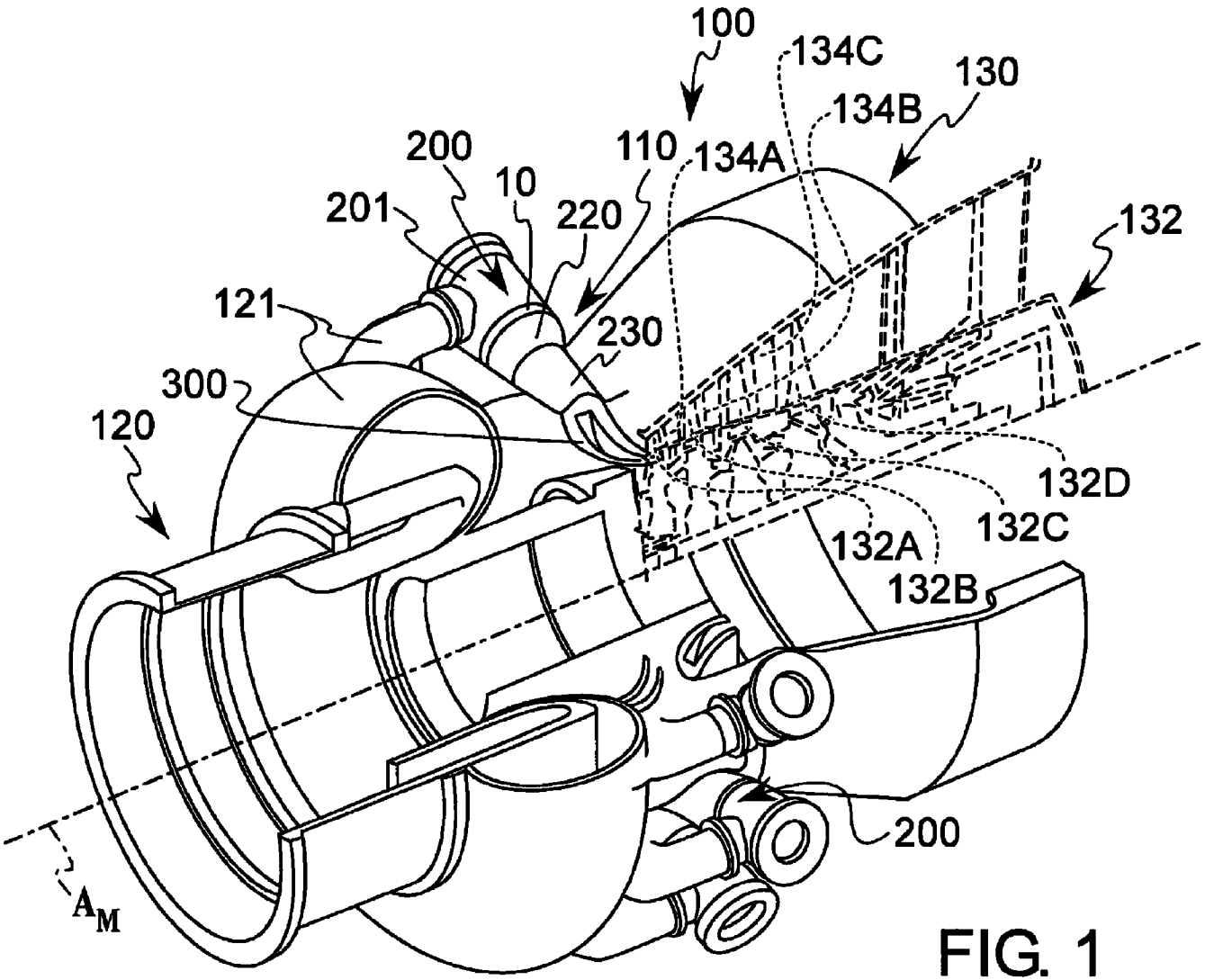
FIG. 1 is a perspective view of a gas turbine engine illustrating in phantom a portion of internal structure of a turbine and in solid line a combustor with a portion of the combustor removed.
Figure 2:
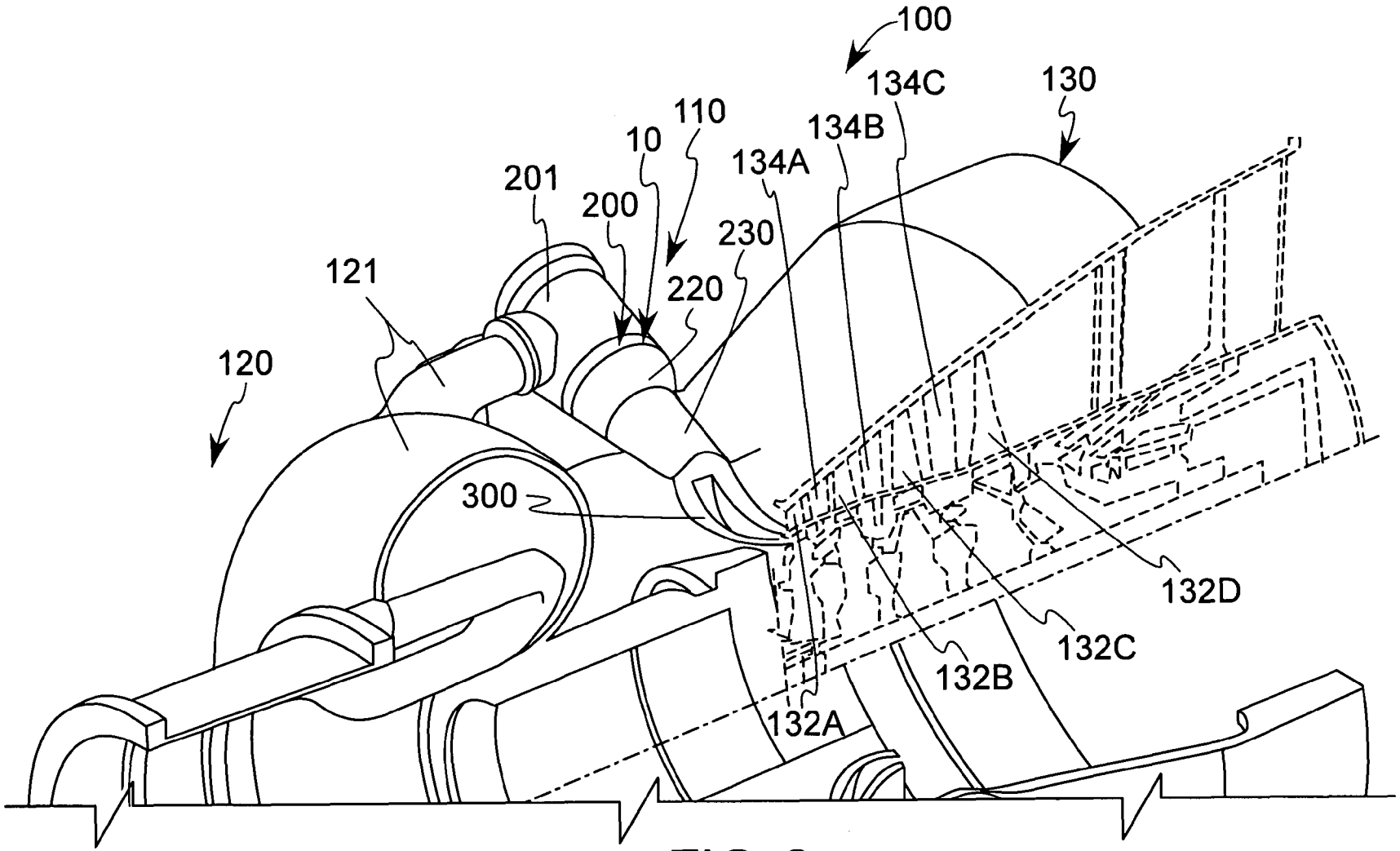
FIG. 2 is an enlarged perspective view of the gas turbine engine illustrated in FIG. 1.
Figure 3:
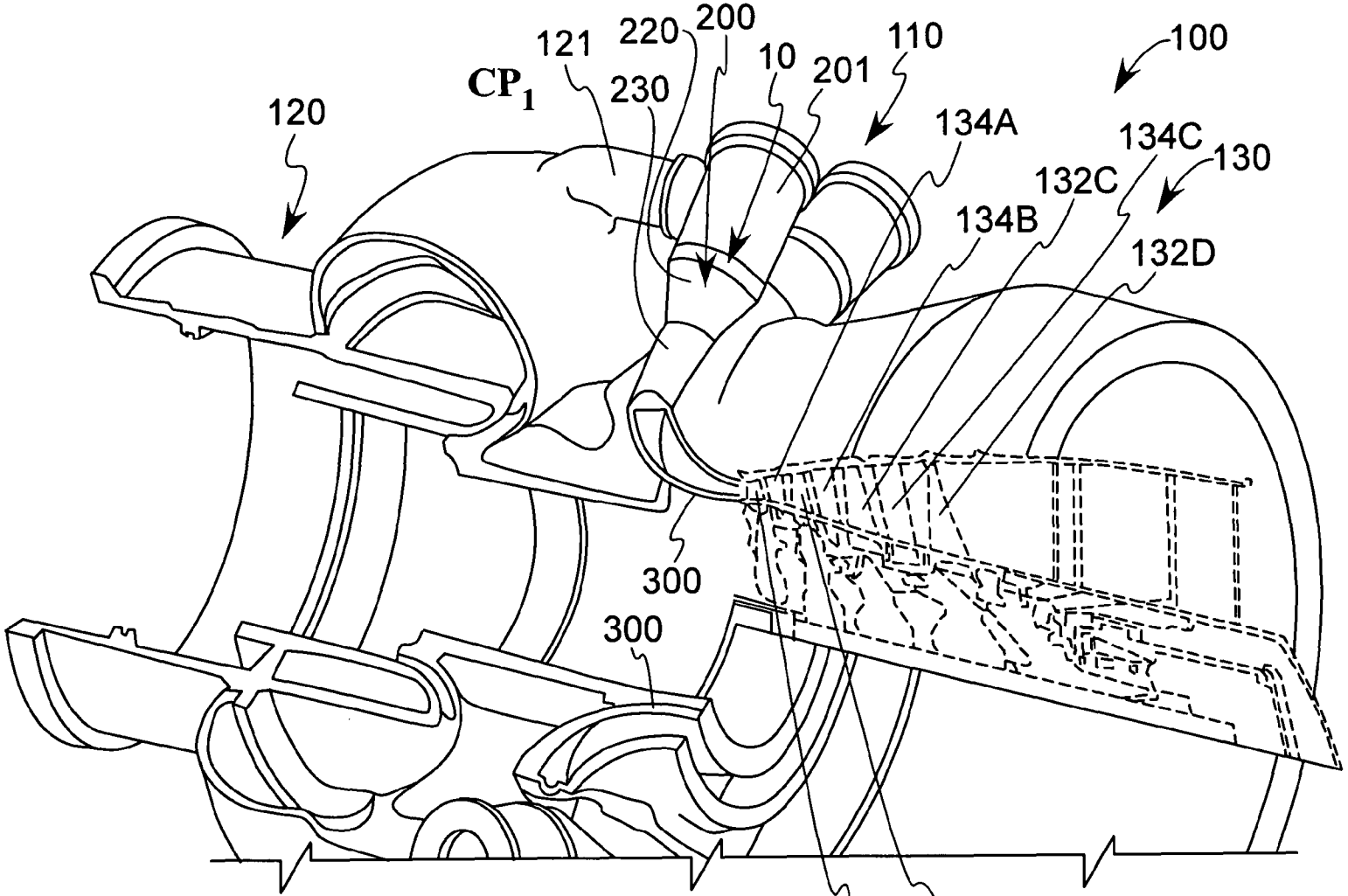
FIG. 3 is an enlarged perspective view, from a different angle as the view in FIG. 2, of the gas turbine engine illustrated in FIG. 1.
Figure 3A:
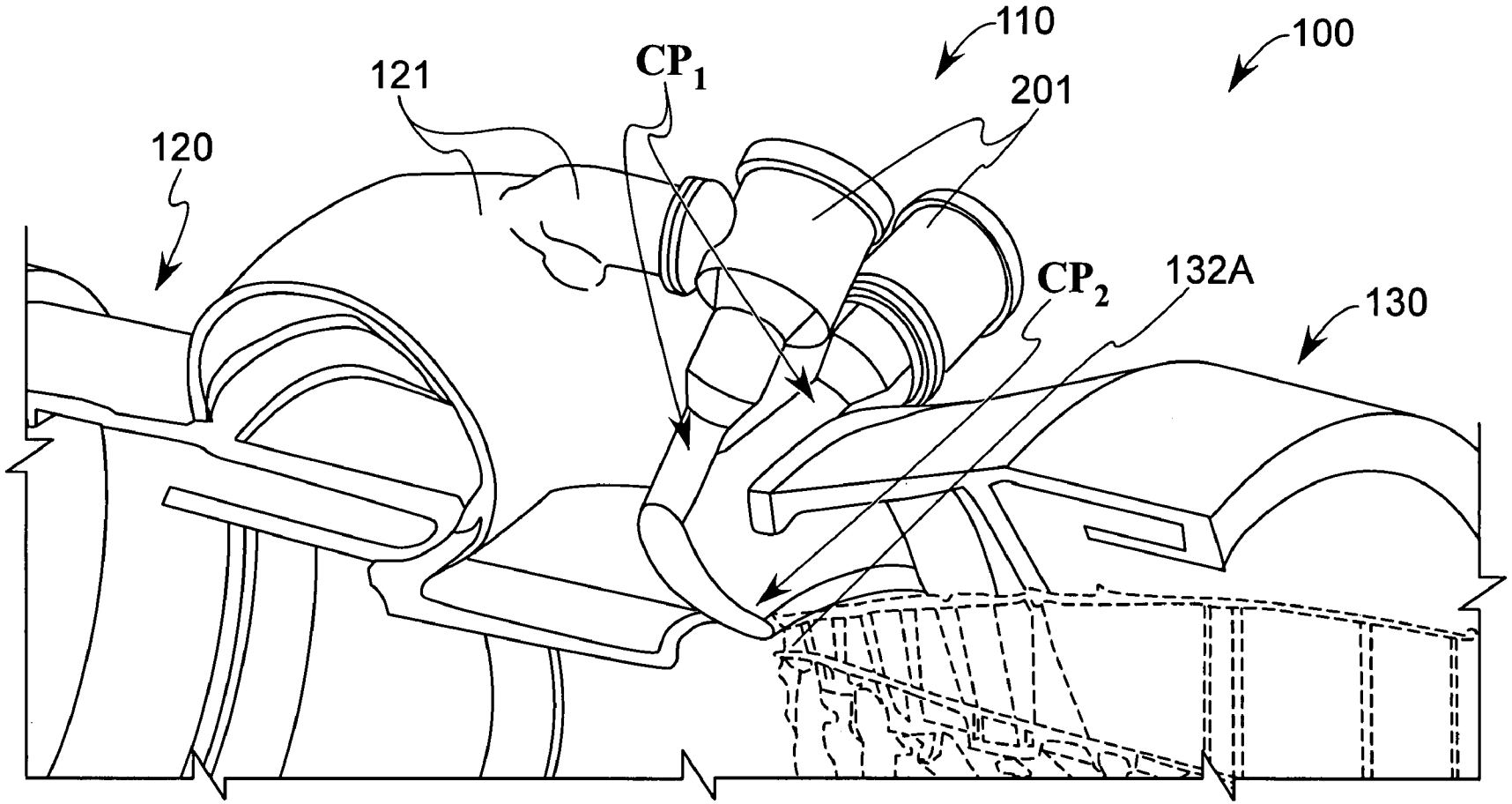
FIG. 3A is an enlarged perspective view similar to FIG. 3, but with the entire duct, all transition elements and all nozzles removed.

Referring now to FIGS. 1-3 and 3A, a gas turbine engine 100 is illustrated including a combustor 110 formed in accordance with the present invention. The engine 100 further includes a conventional compressor 120 for compressing air. The combustor 110 produces expanding hot combustion products or gases by burning fuel in the presence of the compressed air produced by the compressor 120. The engine 100 also includes a turbine 130 having a rotor 132 comprising first, second, third and fourth axially spaced row blade assemblies 132A-132D for receiving the expanding hot combustion products produced in the combustor 110. The expanding hot combustion products impinge upon the blade assemblies 132A-132D to effect rotation of the rotor 132. The turbine 130 further comprises second, third and fourth stationary row vane assemblies 134A-134C for directing the combustion products onto the second, third and fourth blade assemblies 132B-132D. The second vane assembly 134A is located between the first and second blade assemblies 132A and 132B, the third vane assembly 134B is located between the second and third blade assemblies 132B and 132C, and the fourth vane assembly 134C is located between the third and fourth blade assemblies 132C and 132D. In the illustrated embodiment, a vane assembly, i.e., a first vane assembly, is not provided between the combustor 110 and the first blade assembly 132A. The fuel burned in the combustor 110 may comprise, for example, natural or synthetic gas or hydrogen.

In the illustrated embodiment, the combustor 110 comprises a plurality of combustion apparatuses 200 and a duct structure 300. Each combustion apparatus 200, see FIGS. 1-3, comprises a combustion system 10 to receive fuel and air, ignite at least a portion of the fuel and air and output a stream of first combustion products $CP_1$ and any remaining fuel and air. Each combustion apparatus 200 further comprises a nozzle 220 coupled to a corresponding combustion system 10 for receiving and accelerating the first combustion products $CP_1$ and any remaining fuel and air from the combustion system 10 in a direction normal to a machine axis $A_M$ of the gas turbine engine 100, see FIGS. 1-3 and 3A (the combustion apparatuses 200 have been removed from FIG. 3A). The first combustion products $CP_1$ and any remaining fuel and air from the combustion system 10 are inherently cooled when accelerated by a corresponding nozzle 220. In the illustrated embodiment, each nozzle 220 comprises a cone, but could comprise any structure which performs an accelerating function. The cone may have a ratio of an exit cross sectional area to an entrance cross sectional area of from about 1:2 to about 1:6 and preferably about 1:4. Each combustion apparatus 200 also comprises a tube 230, also referred to herein as a transition element, coupled to and positioned between a corresponding nozzle 220 and the duct 310, see FIGS. 2, 3 and 4. Each tube 230 has an internal bore with a substantially constant cross-sectional area along its length. The first combustion products $CP_1$ and any remaining fuel and air from the combustion system 10 may be accelerated by a corresponding nozzle 220 to a speed of between about mach 0.4 to about mach 0.6.

The duct structure 300 receives the first combustion products $CP_1$ and any remaining fuel and air from the tubes 230 of the combustion apparatuses 200, allows any remaining fuel and air to combust to generate second combustion products $CP_2$, accelerates the first and second combustion products $CP_1$ and $CP_2$ and outputs the first and second combustion products $CP_1$ and $CP_2$ to the first row blade assembly 132A to effect rotation of the rotor 132, see FIGS. 1-3 and 3A.

Figure 5:
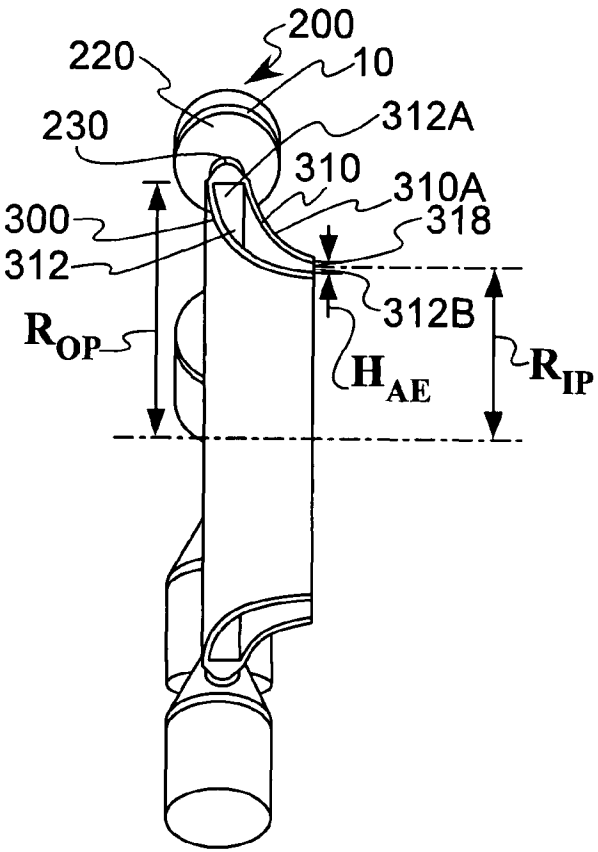
FIG. 5 is a view taken along view line 5-5 in FIG. 4.
Figure 4:
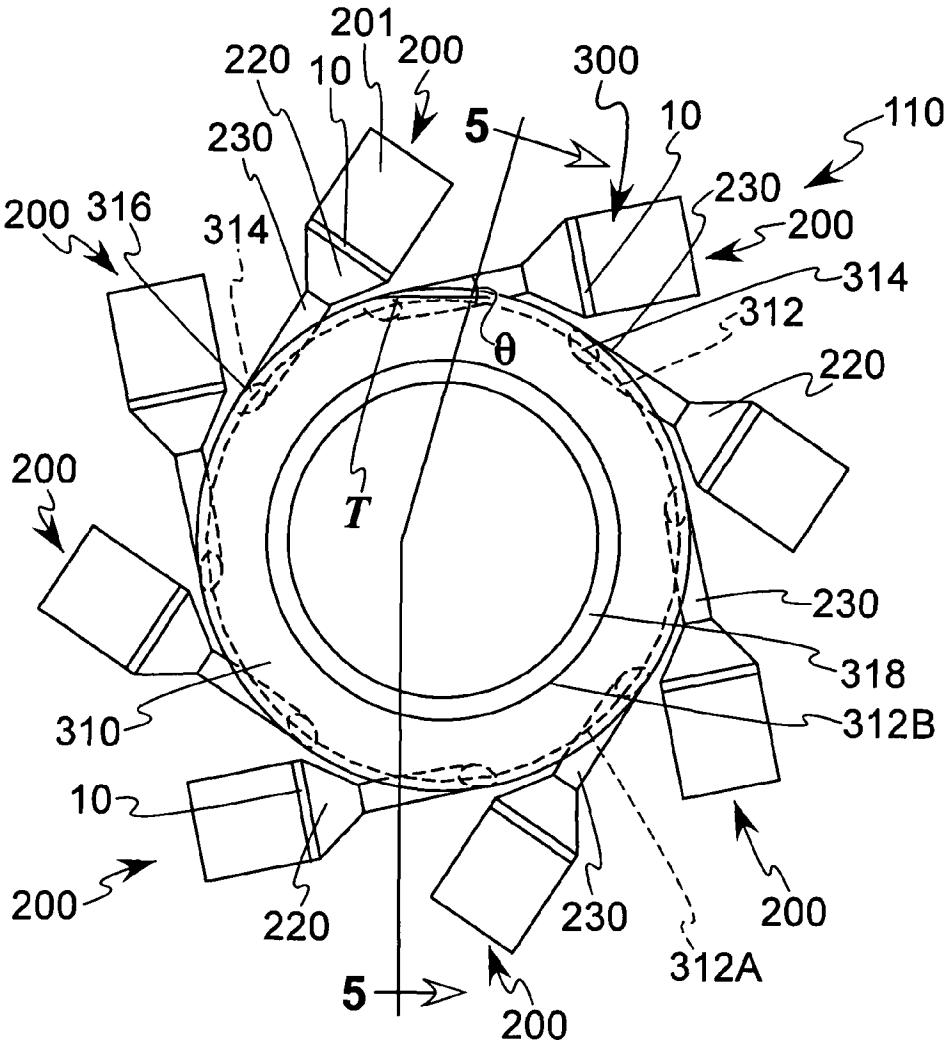
FIG. 4 is an exit side view of the combustor of the gas turbine engine of FIG. 1.

The duct structure 300 may comprise a duct 310 having an annular inner cavity 312, a plurality of entrances 314 extending from an outer periphery 316 of the duct 310 into the inner cavity 312, and an annular exit 318, see FIGS. 4 and 5. As is apparent from FIG. 5, the annular inner cavity 312 has a substantially J-shaped cross section. The entrances 314 communicate with an outer portion 312A of the inner cavity 312 having a radius $R_{OP}$ and the annular exit 318 communicates with an inner portion 312B of the inner cavity 312 having a radius $R_{IP}$, see FIG. 5. The J-shaped cross section of the inner cavity 312 allows the duct 310 to impart momentum in a direction substantially parallel to the machine axis $A_M$ to the first and second combustion products $CP_1$ and $CP_2$ as they pass through the duct 310. The entire duct 310, all nozzles 220 and all tubes 230 have been removed in FIG. 3A to show the path taken by the combustion products $CP_1$ and $CP_2$ and any remaining fuel and air as they move through the combustion apparatuses 200 and the duct 310.

Each tube 230 is coupled to the duct 310 so as to communicate with a corresponding entrance 314 in the duct 310 to allow the first combustion products $CP_1$ and any remaining fuel and air from a corresponding nozzle 220 to pass into the annular inner cavity 312 of the duct 310, see FIGS. 4 and 5. Each tube 230 may be canted inwardly at an angle θ of from about 10 degrees to about 40 degrees to a tangent T to the annular inner cavity 312 of the duct 310 so as to cause the combustion products and any remaining fuel and air to rotate or swirl to create a spinning vortex within the duct annular cavity 312, see FIG. 4. Any remaining fuel and air in the annular inner cavity 312 is allowed to combust in the annular inner cavity 312 to generate the second combustion products $CP_2$. The duct annular exit 318 outputs the first and second combustion products $CP_1$ and $CP_2$ at a velocity having axial and tangential components required to effect rotation of the rotor 132. It is preferred that no fuel remain in the gases when they exit the duct annular exit 318.

In order for the turbine rotor 132 to rotate at an optimal rate, the combustion products $CP_1$ and $CP_2$ leaving the duct annular exit 318 preferably impinge upon the first row blade assembly 132A at a predefined temperature, gas mass flow rate and velocity having desired axial and tangential components. The temperature of the combustion products $CP_1$ and $CP_2$ leaving the duct annular exit 318 can be varied by varying the amount of fuel added to first and second injectors 30 and 40, which injectors 30 and 40 are discussed below; the mass flow rate of the combustion products $CP_1$ and $CP_2$ leaving the duct annular exit 318 can be varied by varying the air mass flow rate into the compressor 120; the axial velocity component of the combustion products $CP_1$ and $CP_2$ leaving the duct annular exit 318 can be varied by varying a radial height $H_{AE}$ of the duct annular exit 318, see FIG. 5; and the tangential velocity component of the combustion products $CP_1$ and $CP_2$ leaving the duct annular exit 318 can be varied by varying one or more of the exit diameter of each nozzle 220, the exit temperature of the first combustion products $CP_1$ and any remaining fuel and air leaving the nozzles 220, and a ratio of the radius $R_{IP}$ of the inner portion 3128 of the inner cavity 312 to the radius $R_{OP}$ of the outer portion 312A of the inner cavity 312.

Substantially all of the momentum in a direction normal to the machine axis $A_M$ of the first and second combustion products $CP_1$ and $CP_2$ is imparted prior to the duct 310, i.e., by the combustion apparatuses 200. That is, substantially all of the momentum in the direction normal to the machine axis $A_M$ of the first and second combustion products $CP_1$ and $CP_2$ originates in the first combustion products $CP_1$ and any remaining fuel and air prior to the first combustion products $CP_1$ and any remaining fuel and air reaching the duct structure 300. Hence, very little, if any, momentum in the direction normal to the machine axis $A_M$ is imparted to the combustion products $CP_1$ and any remaining fuel and air once the combustion products $CP_1$ and any remaining fuel and air enter the duct annular inner cavity 312. However, substantially all of the momentum in a direction substantially parallel to the machine axis $A_M$ of the first and second combustion products $CP_1$ and $CP_2$ is imparted within the duct structure 300 due to the geometry or J-shaped cross section of the duct inner cavity 312.

In most conventional gas turbine engines, a first row stationary vane assembly is provided between the combustor and a first row blade assembly. The first stationary vane assembly functions to divert hot combustion products from the combustor onto the first row blade assembly and, in doing so, substantially accelerates those combustion products in directions normal and parallel to the machine axis to cause the combustion products to move at a velocity having desired axial and tangential components when impinging upon the first row blade assembly to impart optimal forces onto the first blade assembly. In conventional turbine engines, the static and total temperatures of the hot combustion products are generally equal to one another prior to reaching the first row stationary vane assembly since the velocity of the hot combustion products coming from the combustor is low. Generally, the formation of $NO_x$ emissions is a function of the static temperature of the combustion products. Since there is a long residence time between the creation of the combustion products in the combustor until those combustion products are cooled in the turbine and in order to limit $NO_x$ emissions so as to comply with environmental regulations, most conventional gas turbine engine combustors output combustion products at maximum temperatures no greater than about 1550-1600 degrees C.

In the present invention, the combustion apparatuses 200 and the duct 310 cause the first and second combustion products $CP_1$ and $CP_2$ to be directed to the first row blade assembly 132A at a velocity having desired axial and tangential components. Accordingly, a stationary row vane assembly is not provided in the turbine 130 of the present invention between the combustor 110 and the first row blade assembly 132A, resulting in a substantial cost savings in the construction and maintenance of the turbine 130.

It is noted that only pressure loads, i.e., no twisting loads, are created in the duct 310, the tubes 230 and the cones 220. Hence, the duct 310, the tubes 230 and the cones 220 may be formed from an oxide system ceramic matrix composite. A ceramic oxide coating may be provided on the duct 310, tubes 230 and cones 220 when formed from the ceramic matrix composition to protect against high temperatures. The duct 310, tubes 230 and cones 220 may also be formed from a nickel-based superalloy or a cobalt-based superalloy. If formed from a superalloy, the duct 310, tubes 230 and cones 220 are preferably cooled via air or steam. Also, a conventional thermal barrier coating may be provided over the superalloy.

In the illustrated embodiment, the combustion system 10 forming part of each combustion apparatus 200 is constructed as an axially staged combustion system 10, as discussed and illustrated in related U.S. patent application Ser. No. 11/498,480, entitled "AN AXIALLY STAGED COMBUSTION SYSTEM FOR A GAS TURBINE ENGINE," now U.S. Pat. No. 7,631,499, which has previously been incorporated by reference herein. However, it is contemplated that the combustion systems 10 of the combustion apparatuses 200 may alternatively comprise other axially staged combustion systems or non-axially staged combustion systems.

Since each of the combustion systems 10 may be constructed in the same manner, only one combustion system 10 will be described in detail herein.

Figure 6A:
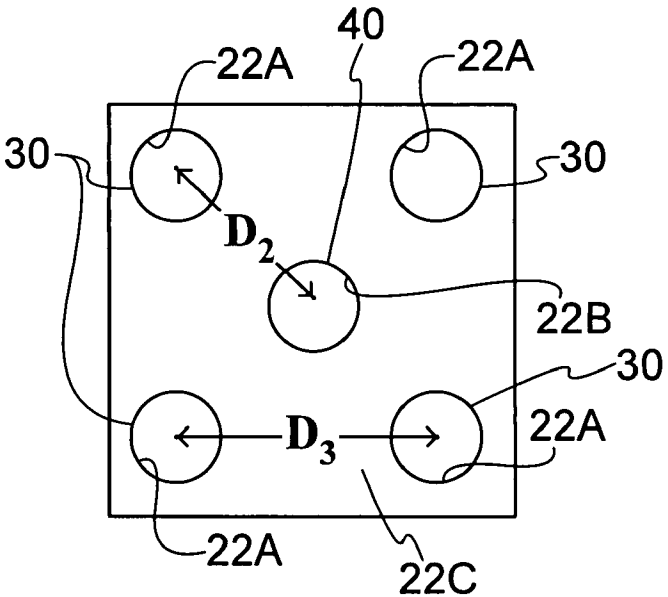
FIG. 6A is an enlarged portion of the main body structure illustrated in FIG. 6.
Figure 6:
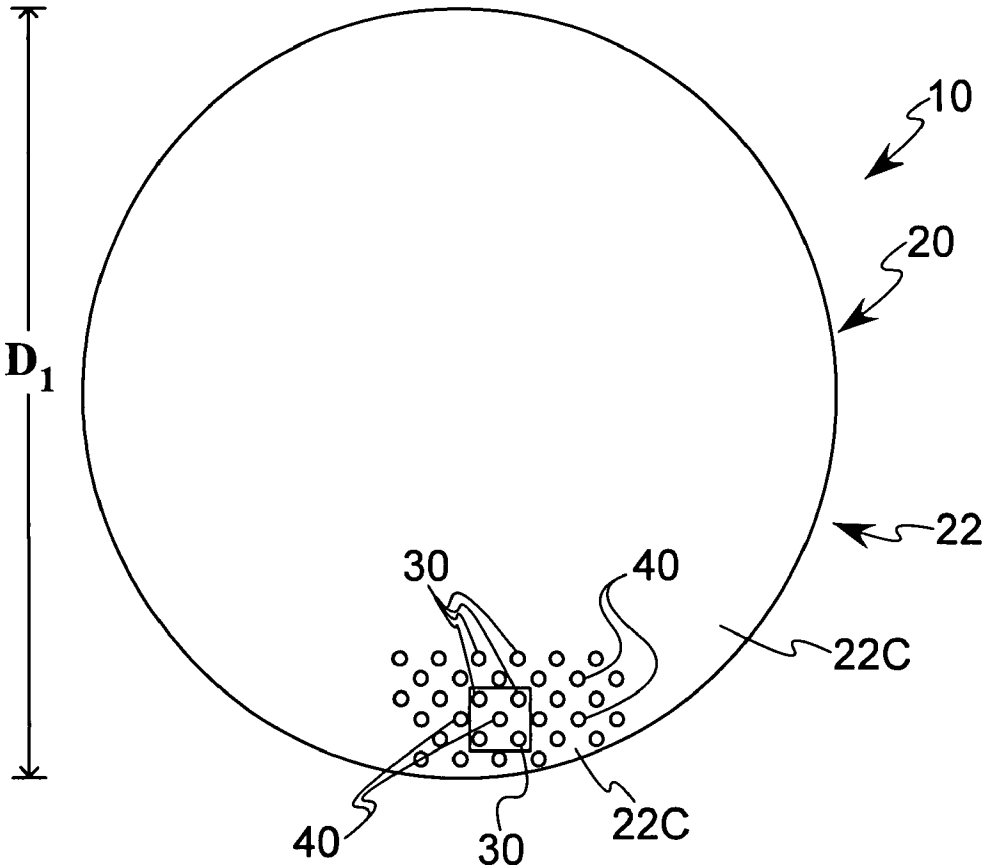
FIG. 6 is a plan view of a main body structure of an axially staged combustion system.
Figure 7:
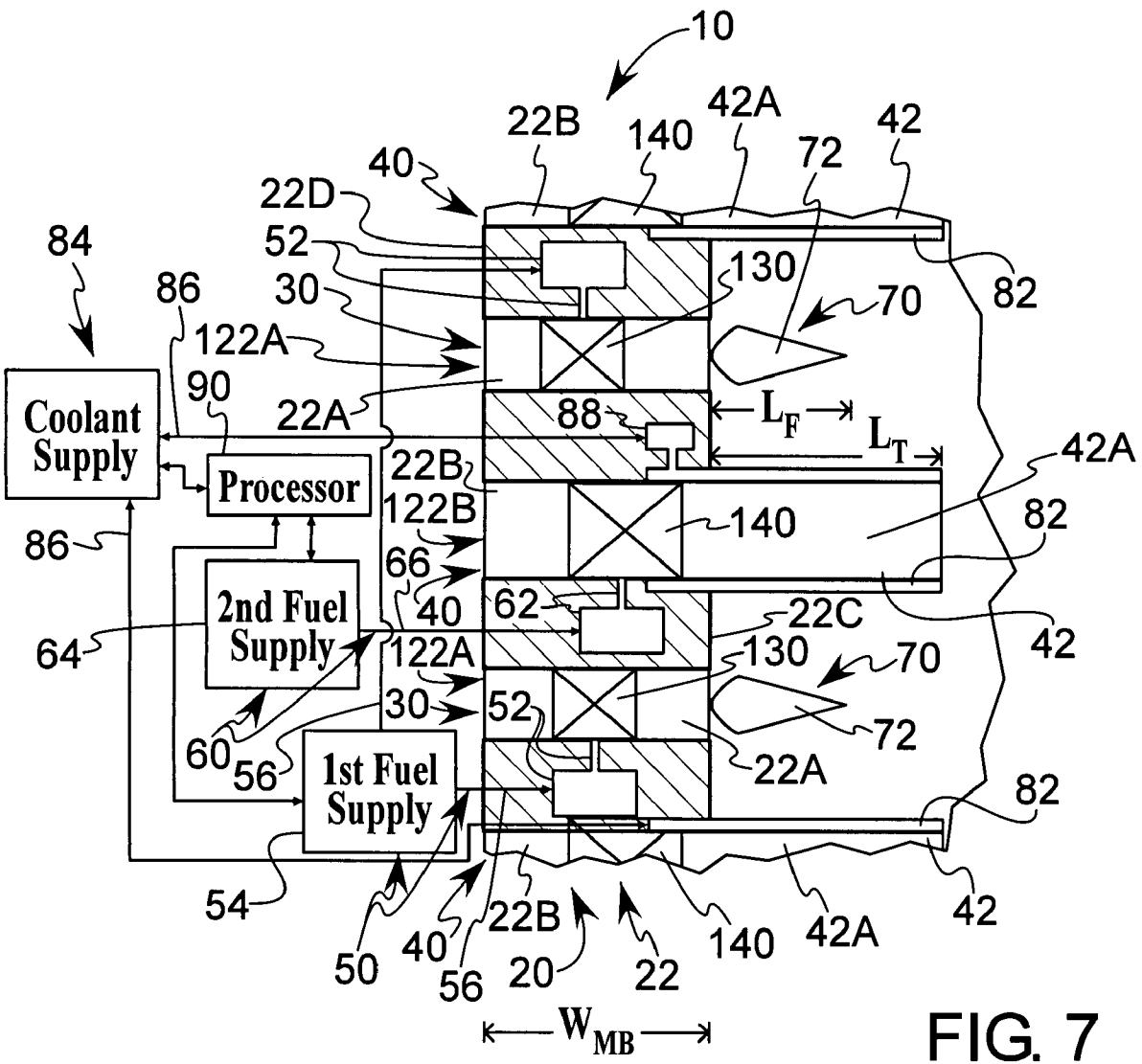
FIG. 7 is a schematic cross sectional view of a portion of the main body structure illustrated in FIG. 6 and including schematic representations of first and second fuel supplies and a coolant supply.

Referring now to FIGS. 6, 6A and 7, the combustion system 10 comprises a main body structure 20 including a plurality of first injectors 30 and a plurality of second injectors 40. The main body structure 20 may be formed from a nickel-based material using a macrolamination process, which process is commercially available from Parker-Hannifin Corporation. The combustion system 10 further comprises first and second fuel feed structures 50 and 60, respectively, see FIG. 7. The first fuel feed structure 50 provides fuel to the first injectors 30, while the second fuel feed structure 60 provides fuel to the second injectors 40.

In the illustrated embodiment, the main body structure 20 comprises a main body unit 22 having a plurality of first passages 22A defining the first injectors 30 and a plurality of second passages 22B, see FIG. 7. The main body unit 22 has a circular shape, including circular first and second outer surfaces 22C and 22D, and a diameter $D_1$ of from about 20 cm to about 60 cm, see FIGS. 6 and 7. The main body unit 22 also has a width $W_{MB}$ of from about 2 cm to about 10 cm, see FIG. 7. It is noted that the shape of the main body unit 22 is not required to be circular and may be square, rectangular, or any other geometric shape.

The first and second passages 22A and 22B extend completely through the main body unit 22, see FIG. 7. Each of the first and second passages 22A and 22B may be circular in cross section. The first passages 22A have a first diameter of from about 0.5 cm to about 2 cm and the second passages 22B have a second diameter of from about 0.5 cm to about 2 cm. A distance $D_2$ between center axes of adjacent first and second passages 22A and 22B may fall within a range of from about two times the first diameter of a first passage 22A and about four times the first diameter of the first passage 22A, see FIG. 6A. A distance $D_3$ between center axes of adjacent first passages 22A may be from about two times the first diameter of a first passage 22A and about four times the first diameter of the first passage 22A, see FIG. 6A. A ratio of the first passages 22A to the second passages 22B may be from about 2/1 to about 6/1. It is noted that two or more of the first passages 22A may have different diameters, two or more of the second passages 22B may have different diameters, and/or at least one of the first passages 22A may have a diameter different from the diameter of at least one of the second passages 22B. It is also noted that the cross sectional shape of the first and second passages 22A and 22B is not required to be circular and may be square, rectangular, or any other geometric shape.

Each of the second injectors 40 is defined by a second passage 22B and a corresponding tube 42, see FIG. 7. It is contemplated that the tubes 42 may be formed integral with the main body unit 22 or comprise separate tubular elements inserted into the second passages 22B. In either case, the tubes 42 have a section 42A extending from the first outer surface 22C of the main body unit 22 and through a flame front 70 defined by flames 72 resulting from the combustion of fuel and air passing through the first injectors 30. Preferably, the tube sections 42A have a length $L_T$, as measured from the first outer surface 22C, greater than an average length $L_F$ of the flame front 70 so as to allow fuel to exit the second injectors 40 without immediately combusting. The tube section length $L_T$ should exceed the average length $L_F$ of the flame front by an amount sufficient to prevent immediate combustion of the fuel exiting the second injectors 40. For example, when the first passages 22A have a first diameter of from about 0.5 cm to about 2 cm, it is contemplated that the flame front 70 will have an average length $L_F$, when measured from the outer surface 22C, of from about 1 cm to about 6 cm. In this example, it is believed that the tube sections 42A should have a length of from about 2 cm to about 10 cm so as to extend beyond the average length $L_F$ of the flame front 70 by between about 1 cm to about 4 cm.

It is noted that a section 42A of a first tube 42 may have a length which differs from a length of a section 42A of a second tube 42. In any event, it is preferred that the lengths of the first and second tube sections be greater than the average length $L_F$ of the flame front 70.

The first fuel feed structure 50 comprises a plurality of first passageways 52 formed in the main body unit 22. At least one first passageway 52 communicates with each first passage 22A so as to provide a path for fuel to enter each first passage 22A. A first fuel supply 54 provides fuel to the first passageways 52 via one or more fuel lines 56. A processor 90 is coupled to the first fuel supply 54 to control the rate at which fluid is supplied to the first passages 22A. A single first fuel supply 54 may provide fuel to the first passageways 52 in a plurality of main body units 22.

The second fuel feed structure 60 comprises a plurality of second passageways 62 formed in the main body unit 22. At least one second passageway 62 communicates with each second passage 22B so as to provide a path for fuel to enter the second passage 22B. A second fuel supply 64 provides fuel to the second passageways 62 via one or more fuel lines 66. The processor 90 is coupled to the second fuel supply 64 to control the rate at which fluid is supplied to the second passages 22B. A single second fuel supply 64 may provide fuel to the second passageways 62 in a plurality of main body units 22.

An inlet 122A into each first passage 22A and an inlet 122B into each second passage 22B define entrances through which compressed air from the compressor 4 of the gas turbine engine 2 enters the first and second injectors 30 and 40, see FIG. 7.

A first swirler 130 is provided in each first injector 30 and a second swirler 140 is provided in each second injector 40, see FIG. 7. Each of the first and second swirlers 130 and 140 comprises one or more conventional swirler vanes, which vanes function to generate air turbulence to mix the compressed air from the compressor 4 with the fuel from the fuel feed structures 50, 60. The first and second swirlers 130 and 140 may be formed as an integral part of the main body unit 22 or comprise separate elements inserted into the passages 22A, 22B.

The combustion system 10 may further comprise cooling structure 80 to cool the tubes 42 of the second injectors 40. In the illustrated embodiment, the cooling structure 80 comprises a sleeve 82 positioned about each tube 82, which is adapted to receive a coolant, such as steam, air or another fluid, from a coolant supply 84 via coolant lines 86 and passageways 88 formed in the main body unit 22. A single coolant supply 84 may supply coolant to the sleeves 82 of a plurality of main body structures 20. The cooling structure 80 is illustrated as a closed system such that the fluid supplied to the sleeves 82 returns to the coolant supply 84. However, the coolant supply 84 may supply steam, air or another fluid which exits the sleeves 82 through orifices (not shown) provided in the sleeves 82. Operation of the coolant supply 84 is actively controlled by the processor 90 or passively controlled by the dimensions of the orifices in the sleeves 82.

Operation of the gas turbine engine 100 will now be described. Compressed air generated by the compressor 120 passes through a plenum 121 of the compressor 120 and into housings 201 of the combustion apparatuses 200, see FIGS. 1-3. A corresponding main body structure 20 is mounted to each housing 201. Compressed air flows through the housings 201 and enters the inlets 122A, 122B into the first and second passages 22A, 22B of each main body unit 22. During low and mid-range operation of the gas turbine engine 100, fuel may only be provided to the first passages 22A via operation of the first fuel supply 54. The fuel and compressed air in the first passages 22A are caused to mix via the first swirlers 130. The fuel and compressed air mixture leave the first injectors 30 and ignite resulting in flames 72 defining, for each combustion system 10, a flame front 70 having a length $L_F$, see FIG. 7. A conventional ignition system (not shown) is provided for each main body structure 20 and located near the first injectors 30 for igniting the fuel and compressed air exiting the first injectors 30. Preferably, the fuel is provided to the first injectors 30 at a rate, as controlled by the processor 90 and the first fuel supply 54, so that it mixes with compressed air to create a mixture sufficiently lean such that the temperature of the resulting first combustion products $CP_i$ or gases is sufficiently low not to produce a significant amount of $NO_x$ emissions.

During high gas turbine engine operating conditions, fuel may be provided to both the first and second passages 22A, 22B of each main body unit 22 via the first and second fuel supplies 54 and 64. The fuel and compressed air in the first passages 22A are caused to mix via the first swirlers 130. The fuel and compressed air mixture leaving the first injectors 30 ignite resulting in flames 72 defining the corresponding flame front 70. The flame front 70 is located prior to or partially within a corresponding nozzle 220. The combustion products resulting from the flame front 70 in each combustion system 10 comprise the first combustion products $CP_i$.

The fuel and compressed air in the second passages 22B are caused to mix via the second swirlers 140. As noted above, it is preferred that the second injector tubes 42 have a sufficient length so that the fuel and compressed air mixture leaving those tubes 42 exits a sufficient distance downstream from the corresponding flame front 70 such that the mixture does not immediately ignite after leaving the second injector tubes 42. Instead, it is preferred that the fuel and compressed air mixture leaving the second injectors 40 along with any uncombusted fuel and air from the first injectors 30 auto-ignite once they enter the duct inner cavity 312. The first combustion products $CP_1$, any remaining fuel and air from the first injectors 30 and the fuel and air exiting the second injectors 40 are accelerated when passing through the corresponding nozzle 220. It is noted that the first combustion products $CP_1$, any remaining fuel and air from the first injectors 30 and the fuel and air from the second injectors 40 will inherently be cooled when passing through the corresponding nozzle 220. Such cooling will lower the static temperature of the first combustion products $CP_1$, any remaining uncombusted fuel and air from the first injectors 30 and the fuel and air from the second injectors 40 from about 60 degrees C. to about 80 degrees C. so as to reduce $NO_x$ emissions.

It is contemplated that the fuel and air mixture provided to the second injectors 40, as controlled by the processor 90 and the second fuel supply 64, may be richer than the mixture provided to the first injectors 30 so as to raise the overall temperature of all gases within the duct inner cavity 312. Hence, the temperature of the combustion products or gases within the duct inner cavity 312 will likely be greater than the temperature of the combustion products or gases resulting from the combustion of only the fuel and air mixture exiting the first injectors 30 and located prior to the exits of the second injector tubes 42. However, it is believed that the total residence time that the combustion products or gases will be at the higher temperatures within the duct inner cavity 312 until cooling occurs within the duct 310 and at the first row blade assembly 132A, will be sufficiently small that the resulting $NO_x$ emissions will occur at manageable rate. It is believed that cooling will be effected within the duct 310, such that the static temperature of the first and second combustion products $CP_1$ and $CP_2$ will be reduced from its highest value within the duct inner cavity 312 from between about 60 degrees C. to about 80 degrees C.

Hence, the combustor 110 of the present invention comprises nozzles 220 which function to accelerate and, as a result, cool and reduce the static temperature of the first combustion products $CP_1$ a very short distance downstream from the corresponding flame front 70 so as to reduce the creation of $NO_x$ emissions. The combustor 110 of the present invention also comprises duct 300, which is believed to cool and reduce the static temperature of the second combustion products $CP_2$ just after they are formed within the duct 300 to again limit $NO_x$ formation. Since the static temperatures of the first and second combustion products $CP_1$ are believed to be lowered between about 60 degrees C. and 80 degrees C. very soon after those combustion products $CP_1$ and $CP_2$ are created, it is believed that the combustor 110 of the present invention may be operated at substantially higher temperatures than conventional combustors, i.e., the first and second combustion products $CP_1$ and $CP_2$ can be generated at substantially higher temperatures than is permissible in conventional combustors, yet generate a level of $NO_x$ emissions similar to the levels generated by conventional combustors when the conventional combustors are operated at lower temperatures.

The second injectors 40 are interspersed with the first injectors 30, such that the second injector tubes 42 extend through and beyond the corresponding flame front 70, see FIG. 7. Because the second injectors 40 are interspersed and positioned near the first injectors 30, i.e., each main body unit 22 is provided with a high density of first and second passages 22A, 22B, the fuel provided to the second injectors 40 is able to more fully mix with the compressed air provided to the second injectors 40 as well as remaining air from the first injectors 30. Hence, the number of rich fuel zones downstream from the second injector tubes 42 is reduced, which results in reduced NO emissions.

Because the first diameters of the first passages 22A are small, the average length $L_F$ of each flame front 70 is short. The second injectors 40 are able to be positioned near and interspersed with the first injectors 30 because the average length $L_F$ of each flame front 70 is so small. A long average flame front length $L_F$ would require long second injector tubes 42, which may be difficult to implement in a practical and cost effective manner.

It is contemplated that only fuel or only fuel and a diluent such as steam may be provided to the second injectors 40. Hence, in this embodiment, compressed air will not enter the second passages 22B. Also, second swirlers 140 will not be provided in the second passages 22B.

As discussed above, the combustion apparatuses 200 function to separately generate substantially all of the momentum in a direction normal to the machine axis $A_M$ of the first and second combustion products $CR_1$ and $CP_2$ while the duct structure 300 functions to separately generate substantially all of the momentum in the direction parallel to the machine axis $A_M$ of the first and second combustion products $CP_1$ and $CP_2$. The air mass flow rate through the compressor 120 may be reduced to reduce the power output of the gas turbine engine 100. When decreasing the mass flow rate through the compressor 120, the processor 90 will cause the rate at which fuel is provided to the first passages 22A to decrease so as to keep the fuel to air ratio within the first injectors 30 substantially constant. This is advantageous as the temperature of the first combustion products $CP_1$ and any unburned fuel and air passing through a corresponding nozzle 220 will remain constant, thereby keeping the velocity of the first combustion products $CP_1$ and any unburned fuel and air passing through the corresponding nozzle 220 constant as well. The constant velocity of the first combustion products $CP_1$ and any unburned fuel and air passing through the nozzles 220 will maintain the momentum in the direction normal to the machine axis $A_M$ of the first and second combustion products $CP_1$ and $CP_2$ within the duct 310 constant as well.

The power output of the gas turbine engine 100 is initially reduced by reducing the air mass flow rate going into and through the compressor 120. After about a 50% reduction in power output of the engine 100, further reduction in power output is effected by reducing the fuel provided to the combustion systems 10. However, even when operating at reduced power levels, it is advantageous to maintain the velocity of the first and second combustion products $CP_1$ and $CP_2$ impinging upon the first row blade assembly 132A, including the axial and tangential components of the velocity, substantially constant to keep the turbine 132 operating at an optimal level. In this regard, fuel is initially reduced to the second injectors 40 when reducing power output via fuel reduction. As noted above, by keeping the fuel to air ratio within the first injectors 30 substantially constant, the temperature of the first combustion products $CP_1$ and any unburned fuel and air passing through a corresponding nozzle 220 will remain constant, thereby keeping the velocity of the first combustion products $CP_1$ and any unburned fuel and air passing through the corresponding nozzle 220 constant as well. The constant velocity of the first combustion products $CP_1$ and any unburned fuel and air passing through the nozzles 220 will maintain the momentum in the direction normal to the machine axis $A_M$ of the first and second combustion products $CP_1$ and $CP_2$ within the duct 310 constant. This will result in the ratio of the tangential and axial velocity components of the first and second combustion products $CP_1$ and $CP_2$ impinging upon the first blade assembly 132A remaining substantially constant as fuel is reduced to the second injectors 40. It is noted that the combustion of fuel within the duct 310 causes proportional changes to the tangential and axial velocity components of the first and second combustion products $CP_1$ and $CP_2$, and, hence, does not change the ratio of the velocity tangential component to the velocity axial component. Thus, if the power output of the gas turbine engine 100 is reduced by reducing fuel to the second injectors 40, and not requiring that the fuel to air ratio be lowered within the first injectors 30, the velocity provided to the first row blade assembly 132A, including the axial and tangential components, will remain substantially constant.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. At least one combustion apparatus and duct structure for a gas turbine engine comprising:

at least one combustion apparatus comprising:

a combustion system that receives fuel and air, ignites at least a portion of the fuel and air, and outputs a stream of first combustion products and any remaining fuel and air; and nozzle structure positioned adjacent to said combustion system, said nozzle structure comprising:

an inlet that receives the first combustion products and any remaining fuel and air from said combustion system;

an outlet that outputs the first combustion products and any remaining fuel and air; and a portion that accelerates the first combustion products and any remaining fuel and air from said combustion system in a direction substantially normal to a machine axis; and duct structure comprising:

at least one entrance that receives the first combustion products and any remaining fuel and air from said at least one combustion apparatus;

a cavity where any remaining fuel and air combust to generate second combustion products; and said duct structure comprising a shape that effects an acceleration of the first and second combustion products in a direction substantially parallel to the machine axis.

2. At least one combustion apparatus and duct structure as set out in claim 1, wherein said combustion system is an axially staged combustion system.

3. At least one combustion apparatus and duct structure as set out in claim 1, wherein said nozzle structure injects the first combustion products and any remaining fuel and air from said combustion system radially inwardly into said duct structure.

4. At least one combustion apparatus and duct structure as set out in claim 1, wherein said duct structure further comprises an exit for outputting the first and second combustion products to a first row blade assembly to effect rotation of the first row blade assembly.

5. At least one combustion apparatus and duct structure as set out in claim 4, wherein said duct structure comprises a duct having an annular inner cavity with at least one entrance and an annular exit, said exit outputting the first and second combustion products at a velocity having axial and tangential components required to effect a desired rotation of the first row blade assembly.

6. At least one combustion apparatus and duct structure as set out in claim 5, wherein said at least one combustion apparatus further comprises a transition element coupled between said nozzle structure and said at least one entrance of said duct to direct the first combustion products and any remaining fuel and air to said at least one duct entrance and into said annular inner cavity of said duct, any remaining fuel and air in the annular inner cavity combusting in the annular inner cavity to generate the second combustion products.

7. At least one combustion apparatus and duct structure as set out in claim 6, wherein said transition element is canted inwardly at an angle of from about 10 degrees to about 40 degrees to a tangent to the annular inner cavity of said duct.

8. At least one combustion apparatus and duct structure as set out in claim 6, wherein said at least one combustion apparatus comprises first and second combustion apparatuses and said at least one entrance in said duct comprises first and second entrances in said duct, a first transition element of said first combustion apparatus is coupled between a nozzle structure of said first combustion apparatus and said first entrance in said duct and a second transition element of said second combustion apparatus is coupled between a nozzle structure of said second combustion apparatus and said second entrance in said duct.

9. At least one combustion apparatus and duct structure as set out in claim 6, wherein said nozzle structure comprises a cone.

10. At least one combustion apparatus and duct structure as set out in claim 9, wherein each of said duct, said transition element and said cone are made from one of a ceramic matrix composite, a nickel-based superalloy and a cobalt-based superalloy.

11. At least one combustion apparatus and duct structure for a gas turbine engine comprising:

at least one combustion apparatus comprising:

a combustion system that:

receives fuel and air;

ignites at least a portion of the fuel and air; and outputs a stream of first combustion products and any remaining fuel and air;

nozzle structure positioned adjacent to and downstream from said combustion system, said nozzle structure comprising:

an inlet that receives the first combustion products and any remaining fuel and air from said combustion system;

an outlet that outputs the first combustion products and any remaining fuel and air; and a portion that accelerates the first combustion products and any remaining fuel and air from said combustion system in a direction substantially normal to a machine axis; and duct structure positioned downstream from said nozzle structure said duct structure comprising:

at least one entrance that receives the first combustion products and any remaining fuel and air from said at least one combustion apparatus;

a cavity where any remaining fuel and air combust to generate second combustion products; and said duct structure comprising a cross sectional shape that effects an acceleration of the first and second combustion products in a direction substantially parallel to the machine axis; and wherein said nozzle structure injects the first combustion products and any remaining fuel and air from said combustion system radially inwardly into said duct structure.

12. At least one combustion apparatus and duct structure as set out in claim 11, wherein said combustion system is an axially staged combustion system.

13. At least one combustion apparatus and duct structure as set out in claim 11, wherein said duct structure further comprises an exit that outputs the first and second combustion products to a first row blade assembly to effect rotation of the first row blade assembly.

14. At least one combustion apparatus and duct structure as set out in claim 13, wherein said duct structure comprises a duct having an annular inner cavity with at least one entrance and an annular exit, said exit outputting the first and second combustion products at a velocity having axial and tangential components required to effect a desired rotation of the first row blade assembly.

15. At least one combustion apparatus and duct structure as set out in claim 14, wherein said at least one combustion apparatus further comprises a transition element coupled between said nozzle structure and said at least one entrance of said duct to direct the first combustion products and any remaining fuel and air to said at least one duct entrance and into said annular inner cavity of said duct, any remaining fuel and air in the annular inner cavity combusting in the annular inner cavity to generate the second combustion products.

16. At least one combustion apparatus and duct structure as set out in claim 15, wherein said transition element is canted inwardly at an angle of from about 10 degrees to about 40 degrees to a tangent to the annular inner cavity of said duct.

17. At least one combustion apparatus and duct structure as set out in claim 15, wherein said at least one combustion apparatus comprises first and second combustion apparatuses and said at least one entrance in said duct comprises first and second entrances in said duct, a first transition element of said first combustion apparatus is coupled between a nozzle structure of said first combustion apparatus and said first entrance in said duct and a second transition element of said second combustion apparatus is coupled between a nozzle structure of said second combustion apparatus and said second entrance in said duct.

18. At least one combustion apparatus and duct structure as set out in claim 15, wherein said nozzle structure comprises a cone.

19. At least one combustion apparatus and duct structure as set out in claim 18, wherein each of said duct, said transition element and said cone are made from one of a ceramic matrix composite, a nickel-based superalloy and a cobalt-based superalloy.

* * * * *